US005396822A

United States Patent [19]

Itokawa

[11] Patent Number: 5,396,822

[45] Date of Patent: Mar. 14, 1995

[54] STRINGED INSTRUMENT FOR USE WITH A BOW

[76] Inventor: Hideo Itokawa, 5-1-9 Kamiuma Setagaya-ku, Tokyo, Japan

[21] Appl. No.: 34,355

[22] Filed: Mar. 19, 1993

[30] Foreign Application Priority Data

Mar. 25, 1992 [JP] Japan ..... 4-066922

[51] Int. Cl.[6] ..... G10D 3/00

[52] U.S. Cl. ..... 84/291; 84/276; 84/277

[58] Field of Search ..... 84/275, 276, 277, 291, 84/293

[56] References Cited

U.S. PATENT DOCUMENTS 1,876,558 9/1932 Bonewitz ..... 84/291
2,800,051 7/1957 Arlington ..... 84/276
4,056,034 11/1977 Kaman ..... 84/291 X

*Primary Examiner*—Michael L. Gellner
*Assistant Examiner*—Patrick J. Stanzione
*Attorney, Agent, or Firm*—Bauer & Schaffer

[57] ABSTRACT

A string instrument of the invention is capable of producing a stable amount of sounds from a low sound region to a high sound region. A vibration mode is measured when the frequency of a basic vibration of strings becomes equal to that of a basic frequency of a top plate, and two stiffeners of predetermined lengths are attached on the rear surface of a top plate along two nodal lines appearing on the top plate in that vibration mode. The stiflenets do not affect in a low sound region but causes the vibration mode to change in a high sound region, thereby making it possible to produce increased amounts of sounds in every sound region, particularly that on E-line which has been thought to be difficult for a conventional violin to produce.

3 Claims, 17 Drawing Sheets

| | |
|---|---|
| G6 | 3136 |
| F6 | 2793 |
| E6 | 2637.0 |
| D6 | 2349.3 |
| C6 | 2093 |
| B5 | 1975.5 |
| A5 | 1760.0 |
| G5 | 1567.9 |
| F5 | 1396.9 |
| E5 | 1318.5 |
| D5 | 1174.7 |
| C5 | 1016.5 |
| B4 | 987.8 |
| A4 | 880.0 |
| G4 | 783.9 |
| F4 | 698.1 |
| E4 | 660.0 |
| D4 | 587.3 |
| C4 | 523.2 |
| B3 | 493.8 |
| A3 | 440.0 |
| G3 | 392 |
| F3 | 349.2 |
| E3 | 329.6 |
| D3 | 293.6 |
| C3 | 261.6 |
| B2 | 246.9 |
| A2 | 220.0 |
| G2 | 196 |

STRINGED INSTRUMENT FOR USE WITH A BOW

BACKGROUND OF THE INVENTION

1. Field of the Invention

The present invention relates to a string instrument such as violin, viola, cello, or the like which can produce a stable amount of sounds in a low sound region as well as in a high sound region.

2. Description of the Prior Art

A conventional string instrument, for example, a violin is basically constructed in the following manner. Referring to FIG. 1, a violin 1*a* is mainly formed of a body 2 in the shape of gourd and a neck 3 attached to the body 2. Four strings 6 are stretched between pegs 4 attached to the neck 3 and a tailpiece attached on the body 2. These strings 6 are supported by a bridge 7. A bow 8 is slid on these strings 6 to produce sounds. More specifically, referring to FIG. 2, the body 2 of the violin 1*a* is made up of a top plate 9, a bottom plate 10 and side plates 11 for coupling the top and bottom plates 9, 10. The top plate 9 is provided on the rear surface thereof with a bass-bar 12 which serves as a reinforcement to prevent buckling from occurring due to a compression load caused by a tension of the strings 6. A sound-post 13 is further provided between the top plate 9 and the bottom plate 10 such that the bridge 7 is located substantially above the sound-post 13.

As a playing place has changed from a personal hole in the medieval ages to a public concert hole in the present days, it has been required to increasingly produce larger sounds. However, the basic structure of the violin la as described above has not been changed from the era of Antonio Stradivarius for about 300 years except that the tension of the strings 6 was necessarily higher and the bass-bar 12 was provided as reinforcement.

The violin 1*a* constructed as described above is also considered as a sound generating or audio instrument. A sound range of the violin la involves four octaves and extends from 196 C.P.S. to 3136 C.P.S as shown in FIG. 3. An audio instrument has three elements: a vibrating section, a transmitting section for. transmitting the vibration, which also includes a resonance system and a filter system in addition to a transmission system, and a radiating section for radiating sound wave to the air. Comparing these elements to the constituents of the violin 1*a*, the strings 6 correspond to the vibrating section; the bridge 7 to the transmission system and the filter system; air in the body 2, the top plate 9 and the bottom plate 10 to the resonance system; and the top plate 9 to the radiating section. Thus, since the performance of the violin 1*a* may be considered in the same manner as that of a normal audio instrument, the performance may be classified into (1) frequency characteristics; (2) sound quality (spectrum); (3) transient characteristics; (4) efficiency; and (5) directivity.

In these characteristics, the frequency characteristics were measured for four conventionally constructed violins as shown in FIG. 4. Specifically, an oscillator 14 was connected to a side face of the bridge 7 through an amplifier 15, from which sound as an elastic wave was sent to the violin 1*a*. This sound was transmitted from the bridge 7 through the top plate 9, the sound-post 13, the bottom plate 10, the body 2 and air to produce sounds by vibrations of these elements which were picked up by a microphone located seven centimeters above the bridge 7. Also, its sound pressure was measured by an oscillograph 18 through an amplifier 17. The results of the measurement show that the four violins respectively present a response curve substantially as illustrated in FIG. 5. More specifically, the response curve indicates a tendency that a peak distance is wide in a low sound region, and the sound pressure is low, that is, the sound is feeble in a high sound region.

In other words, in the conventional violin 1*a*, while the amplitude of the top plate 9 is large in the low sound region as shown in FIG. 5, the peak distance is wide, so that sound on G line remote from the peak presents a week fundamental tone. To prevent this, the frequency range of the response curve may be extended to the lower region as much as possible. To achieve this, the resonance frequency of the top plate 9 may be lowered as much as possible. The resonance frequency f of the top plate 9 is given by the following equation:

$$f = \frac{h}{2\pi} \sqrt{\frac{E}{12\rho(1 \cdot \mu^2)}} \cdot k$$

where h represents the thickness of the top plate; E the Young's modulus of elasticity; $\mu$ the Poisson's ratio; $\rho$ the specific gravity of the top plate; and K a constant.

It will be understood from the above equation that, without considering the specific gravity of the top plate, a thinner top plate results in shifting the frequency band of the response curve in the lower direction and simultaneously reducing the sharpness of the peak.

However, since the top plate, generally plane and symmetric, always presents a constant frequency ratio between harmonics, reduction of the thickness of the top plate causes the harmonics to simultaneously shift in the lower direction, thereby narrowing the frequency band as a whole. This results in a decrease of the sound amount in the high sound region and generation of dull tone color as a whole. This coincides with an empirically obtained fact that a thinner top plate causes unclear sound.

OBJECTS AND SUMMARY OF THE INVENTION

The present invention has been made in view of the problems mentioned above, and its object is to provide a string instrument in a simple structure which presents the frequency characteristics as plane as possible and has an extended frequency band, and is capable of increasing the radiation of sounds in a high sound region to intensify the sounds.

The inventors have continued to study the acoustic characteristics of string instruments, particularly violin and cello for many years to solve the problems mentioned above. It is natural that researchers of such string instruments desire to play "Swan" composed by Saint-Sans with violin or "Torymerai" composed by Schumann with cello.

However,.as the studies on the acoustic characteristics of the violin and cello have been advanced as described above, it has been revealed that sounds producible by violins and cells so far manufactured are different from each other, and the best intensity and tone color cannot be provided for all sounds. It may therefore be thought that even accomplished violinists and cellists, famous for playing the above-mentioned music, are not capable of completely realizing sounds intended by the composers which are developed in the music. The inventors thus have zealously continued to study the manufacturing of violin in particular in order to reproduce the real sounds intended by the composer which should be represented in the music. As mentioned above, the resonance frequency f of the top plate is given by:

$$f = \frac{h}{2\pi} \sqrt{\frac{E}{12\rho(1 \cdot \mu^2)}} \cdot k$$

The stiffness s of the top plate is given by:

$$s = \frac{Eh^3}{12(1 - \mu^3)}$$

Since a mass m per unit area of the top plate is given by $m=\rho h$, s and m are substituted for the equation of the resonance frequency f to derive the following equation:

$$f = \frac{1}{2\pi} \sqrt{\frac{s}{m}} \cdot h^2$$

It is thought from the above equation that, dividing the frequency band of the response curve indicative of the frequency characteristics of the violin into a high region and a low region, the response curve in the high region may be extended to the higher direction. Stated another way, if the stiffness only is increased for a vibration mode of the high region, the frequency characteristics of the violin can be artificially modified, thus completing the present invention.

In other words, to achieve the above object, a vibration mode of the top plate is measured when the basic vibration of the strings is at the same frequency as that of the basic vibration of the top plate, and two stiffeners of predetermined lengths are provided on the rear surface of the top plate along two nodal lines appearing on the top plate in this vibration mode.

DETAILED DESCRIPTION OF THE PREFERRED EMBODIMENTS

An embodiment of the present invention will hereinafter be described with reference to FIGS. 6–19.

Figure 6:
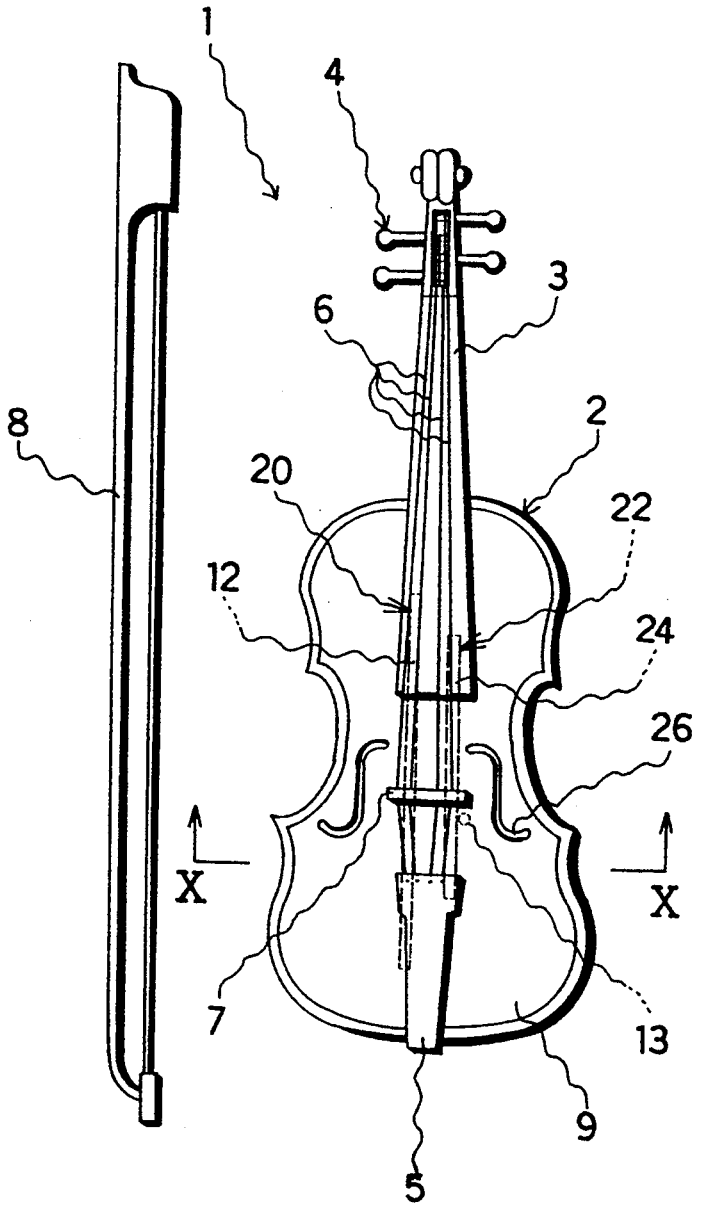
FIG. 6 is a plan view showing a violin which embodies a string instrument of the present invention.
Figure 7:
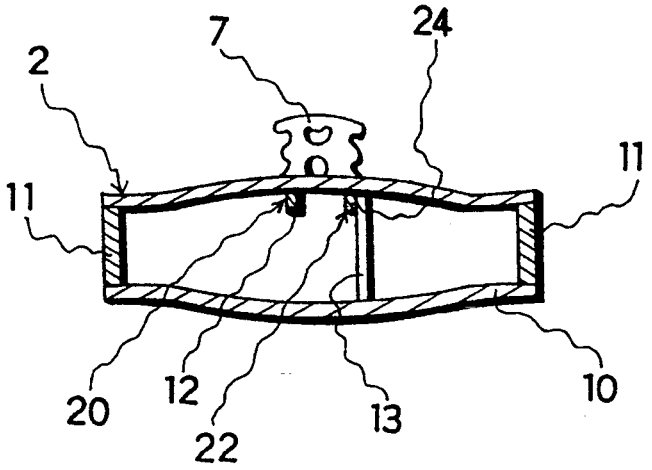
FIG. 7 is a cross-sectional view taken along the X—X line in FIG. 6.
Figure 14:
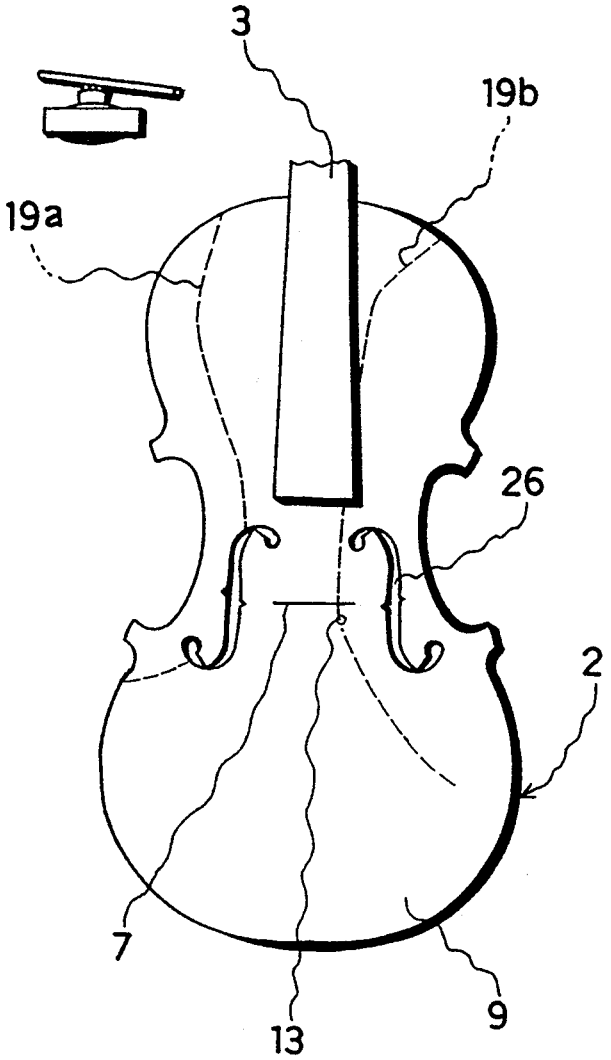
FIGS. 14 and 15 are plan views respectively showing nodal lines appearing on the top plate.
Figure 15:
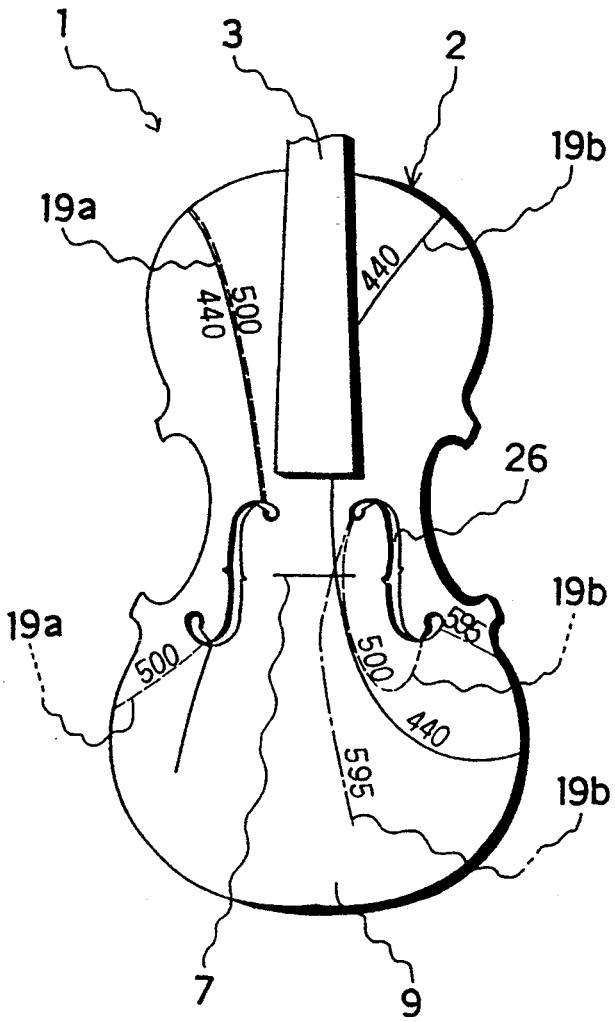

First, referring particularly to FIG. 6, a violin according to the present invention is generally indicated by reference numeral 1. This violin 1 has a substantially similar structure to that of the foregoing conventional violin 1*a*, so that parts common t6 these two violins are designated the same reference numerals, and explanation thereof will be omitted. Specifically explaining the difference therebetween, the violin 1 of the present invention is provided with stiffeners 20, 22 of predetermined lengths on the rear surface of a top plate 9 along two nodal lines 19*a*, 19*b* appearing on the top plate 9, as shown in FIGS. 14, 15, in a vibration mode of the top plate 9 which is measured when the basic vibration of strings 6 is at the same frequency as that of the basic vibration of the top plate 9. Between these stiffeners 20, 22, the stiffener 20 is mounted on the nodal line 19*a* which substantially corresponds to the mounting position of a bass-bar 12 serving as reinforcement for preventing buckling from occurring due to a compression load caused by a tension of the conventional strings 6. It should be noted however that the mounting position of the bass-bar 12 in the conventional violin was empirically determined from the violin manufacturing over 200 years, and the stiffener 20 of the present invention is different from the bass-bar 12 in character. More specifically, the mounting position of the bass-bar 12 is determined on assumption that it hardly affects the tone color since the size and shape of violins have empirically been determined from the violin manufacturing and violin playing techniques over many years, and the shape of violin has been fixed. While the mounting position of the bass-bar 12 is the same in violins of fixed shape, this position cannot be generalized in a large field of string instruments.

The stiffener 22 is mounted on the nodal line 19*b* which has never been known and shows the essence of the present invention. In this embodiment, by providing a rod 24 a bit shorter than the bass-bar 12 on the rear surface 9*a* of the top plate 9, the stiffener 22 does not affect in terms of stiffness and mass in a bass region and provides a different vibration mode in a high sound region by the action of stiffness. Specifically explaining, the stiffener 22 causes the frequency to become higher and hence the frequency band to extend. Therefore, on a response curve of the body 2, radiation of high sounds is increased to produce a larger sound volume, while harmonics are increased on the spectrum of sounds generated by playing the violin with a bow 8. This further increases the radiation of high sounds on the response curve of the body 2, resulting in generating larger sounds. On the other hand, on the spectrum of sounds produced by playing the violin with the bow 8, harmonics are increased. If a person hears the sound improved by the stiffener 22 and the rod 24 with his ears, he will feel that the sounds in general have increased sweetness, where particularly the amount of sound on E-line is increased, and thereby the sounds remarkably spread at the same time. Incidentally, reference numeral 26 in FIG. 6 designates f-shaped holes.

Next, explanation will be given of actions and effects produced by the provision of stiffeners 20, 22 of predetermined lengths on the rear surface 9a of the top plate 9 of the violin 1 with experiment data and theoretical analysis.

Figure 8:
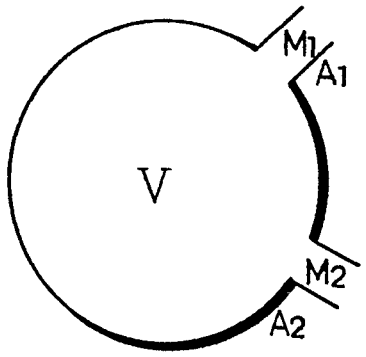
FIG. 8 is a schematic diagram of a Helmholtz resonator.

For confirming that a peak appearing in a lowermost portion of a response curve representative of the frequency characteristics of the body 2 of the violin 1 can be explained as a Helmholtz resonator, a theoretical calculation will be performed with reference to FIG. 8. The body 2 of the violin 1 may be thought as a Helmholtz resonator as shown in FIG. 8 corresponding to the two f-shaped holes 26. Here, a volume V of air is approximated to an internal volume of the body 2 of the violin 1, while the two f-shaped holes 26 are approximated to elliptic openings $A_1$, $A_2$.

A pressure increase developed when the volume V of air in the cavity is compressed by dV in a thermally insulating situation is given by the following calculations:

$$\begin{aligned} P &= -\rho c^2(dV/V) \\ &= -\rho c^2(dV_1 + dV_2)/V \\ &= -\rho c^2(s_1\xi_1 + s_2\mu_2) \end{aligned}$$

where P represents a pressure increase; $\rho$ an air density; c the sound velocity; $dV_1$, $dV_2$ changes of volumes in the openings $A_1$, $A_2$ caused by motion of air parcels; , $\xi_1$, $\xi_2$ displacements of the air parcels in the openings $A_1$, $A_2$; and $s_1$, $s_2$ cross-sectional areas of the openings.

Thus, equations of the motion of the air parcels in the openings $A_1$, $A_2$ are given by:

$$M_1\ddot{\xi}_1 = \cdot\rho c^2(s_1\xi_1 + s_2\xi_2)s_1/V$$

$$M_2\ddot{\xi}_2 = \cdot\rho c^2(s_1\xi_1 + s_2\xi_2)s_2/V$$

where $M_1$, $M_2$ represent masses of the air parcels.

Since $s_1 = s_2 = s$ and $M_1 = M_2 = M$ are satisfied in an actual violin, if $\xi_1 + \xi_2 = X$ is substituted, the above equation is transformed to an equation with one unknown as follows:

$$M\ddot{X} = \cdot\rho c^2 \cdot 2s^2 X/V$$

Here, if $\rho s^2/M = C_O$ is placed, the following equation is derived:

$$\ddot{X} = -2C_0C^2\frac{X}{Y}$$

From this equation, the characteristic frequency f is given by:

$$f = \frac{C}{2\pi}\sqrt{\frac{2C_0}{V}}$$

Figure 9:
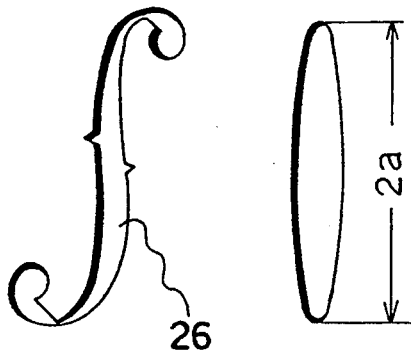
FIG. 9 is a plan view showing a f-shaped hole and an elliptic hole.

Here, $C_O$ represents a transmission coefficient of the f-shaped holes 26 and is difficult to calculate for the actual f-shaped holes 26, so that the f-shaped holes are approximated by elliptic holes as shown in FIG. 9. In this event, the transmission coefficient of the elliptic holes is calculated in the following manner:

$$C_0 = 2\sqrt{\frac{s}{\pi}\cdot\frac{\pi}{2\sqrt{\cos\phi}\cdot F(\sin\phi)}}$$

where s represents the area of the elliptic hole $$(= \pi a^2\sqrt{1 - e^2});$$

and e the eccentricity of the ellipse ($=\sin\Phi$)

$$F(\sin\Phi) = F(e) = \int_0^{\pi} 2\frac{d\theta}{\sqrt{1 - e^2\cos^2\theta}}$$

From actual measurement, $s = 5cm^2$ and $a = 4cm^2$. Therefore:

$$e = \sqrt{1 - \left(\frac{s}{\pi a^2}\right)^2} = 0.994,\ \phi = 84°$$

If $F(e) = 3.8$ is substituted, $C_{O=3.31}$ is derived.

The volume V is derived from actual measurement as $V = 1.84 \times 10^3\ cm^3$.

Then, when V ($=1.84\times10^3\ cm^3$) and c ($=3.4\times10^4$ cm/sec) are substituted for the equation expressing f, f=325 c.p.s. is derived.

It will be appreciated that this value substantially coincides with the experiment value of the peak of the minimum vibration frequency equal to 300 C.P.S.

After confirming that the experimentally derived peak value of the minimum vibration frequency on the response curve except for the air peak is equal to the basic frequency of the top plate 9, the following theoretical calculations were performed in order to clarify the influences of various factors which dominate this vibration.

Figure 10:
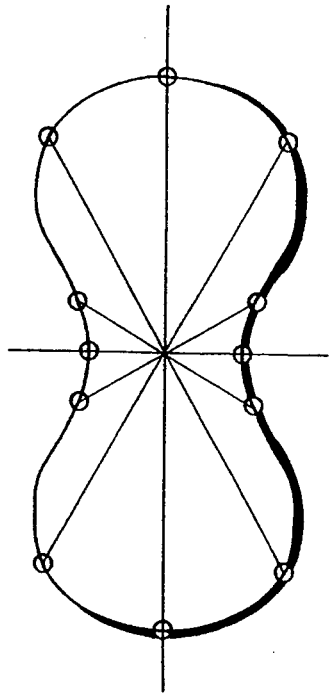
FIG. 10 ms a plan view for defining a boundary condition of a top plate.

Assuming that the top plate is plane and vertically symmetric as shown in FIG. 10, the characteristic frequency thereof is calculated. Selected are 12 points which are given by the following polar equations and their centrally symmetric points:

(1) $\theta_1 = O$; $\gamma_1 = 0.28939$; $W = O$; $\partial W/\partial r = O$
(2) $\theta_2/3\pi$; $\gamma_2 = 0.51298$; $W = O$
(3) $\theta_3 = 4/3\pi$; $\gamma_3 = 0.9157$; $W = O$
(4) $\theta_4\pi/2$; $\gamma_4 = 1.0000$; $W = O$; $\partial W/\partial r = O$ At these points, boundary conditions as set forth above are respectively supposed with respect to deformation W. Specifically, at all of the points (1), (2), (3) and (4), deformation W is supposed to be zero. Also, at $\theta_1 = O$ and $\theta_4 = \pi/2$, the gradient is set to be zero. Under such conditions, a vibration equation of the top plate 9 may be given in polar coordinates as follows:

$$\rho h \frac{\partial^2 W}{\partial t^2} + \frac{Eh^3}{12(1-\mu^2)} V^4 W = 0$$

where $\rho$ represents the specific gravity of the top plate; h the thickness of the top plate; E the Young's modulus of elasticity; and $\mu$ Poisson's ratio.

In steady vibration, $W=\Phi(r\theta)e^{iwt}$ stands. Therefore:

$$\left(\frac{\partial^2}{\partial r^2} + \frac{1}{r}\cdot\frac{\partial}{\partial r} + \frac{1}{r^2}\ \frac{\partial^2}{\partial \theta^2}\right)\phi - K^4\phi = 0$$

where $$W = \sqrt{\frac{Eh^2}{12\rho(1-\rho^2)}\cdot h^2}$$

and $\omega$ is a general solution of $\Phi$.

Next, the boundary conditions are substituted for $\phi$:

$$\phi=\Sigma[A_nJ_n(kr)+B_nI_n(kr)][C_n\cos n\theta+D_n\sin n\theta]$$

to derive Eingenwert. Calculation made with the above values resulted in K=4.89.

Substituting $E=1.05\times10^5$ kg/cm$^2$, $\rho=0.4\times1/980$ gr-sec$^2$/cm$^4$, and $\mu=0.3$ as actual measurement values, and calculating $\kappa$ with the actual length of the major side:

$$\kappa=4.89/(35.5/2)=4.89/17.7=0.278$$

With these values, the characteristic vibration frequency f is calculated in the following manner:

$$f = \frac{1}{2\pi}\sqrt{\frac{E}{21\rho(1-\mu^2)}}\cdot h\cdot K^2 = 688 \text{ c.p.s.}$$

An experiment value is f=550 C.P.S. which is approximately 20% lower than the calculated value. Seemingly, it is because the fixed peripheral conditions do not meat at $\theta_1=O$ and $\theta_4=\pi/2$ and in practice, but the conditions therearound are close to supporting conditions so that these conditions act in a direction of decreasing the vibration frequency.

The foregoing equation of f sufficiently affects factors determining the characteristic vibration frequency of the top plate 9, from which the following facts will be appreciated:

(1) The vibration frequency is proportional to the plate thickness;

(2) The vibration frequency is proportional to a square root of the ratio of the elastic coefficient to the specific gravity; and (3) The value of k depends on the plane shape of the violin. This value can be theoretically calculated with certain approximation.

Figure 1:
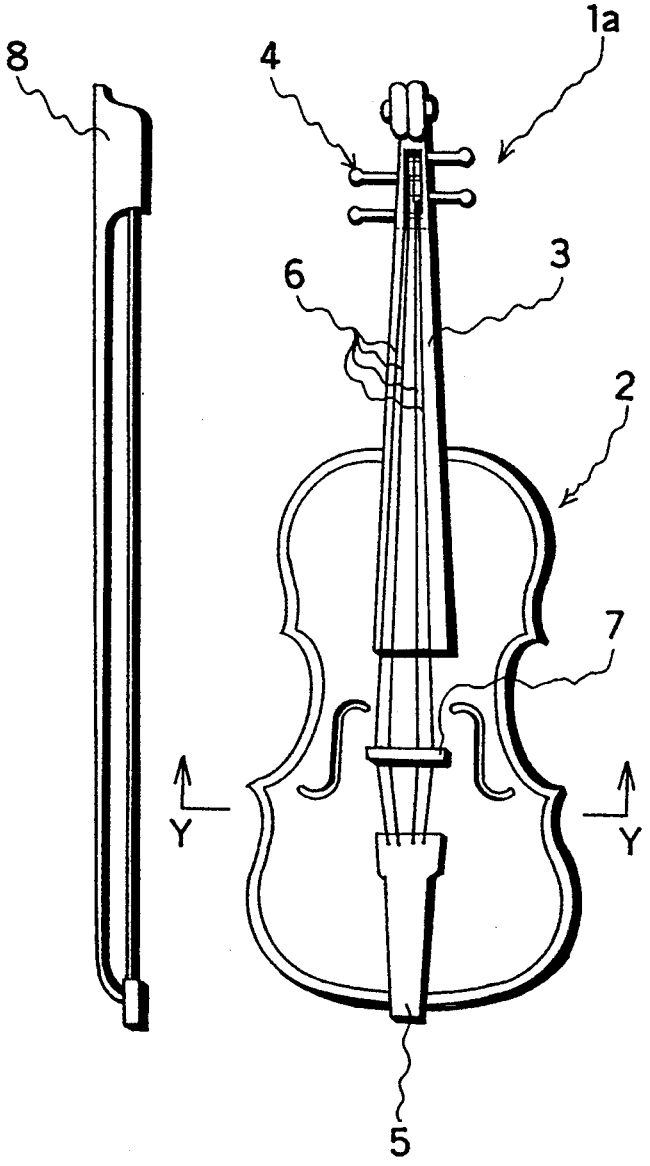
Fig. 1 (Prior art)
FIG. 1 is a plan view showing a conventional violin.
Figure 2:
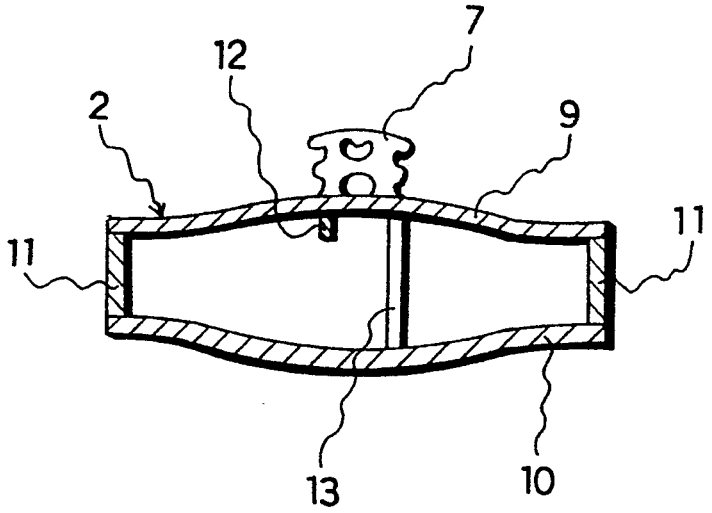
Fig. 2 (Prior art)
FIG. 2 is a cross-sectional view taken along the Y—Y line in FIG. 1.
Figure 3:
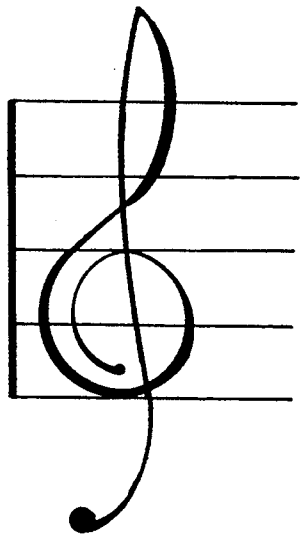
Fig. 3 (Prior art)
FIG. 3 is a graph schematically showing a sound area of the violin.
Figure 4:
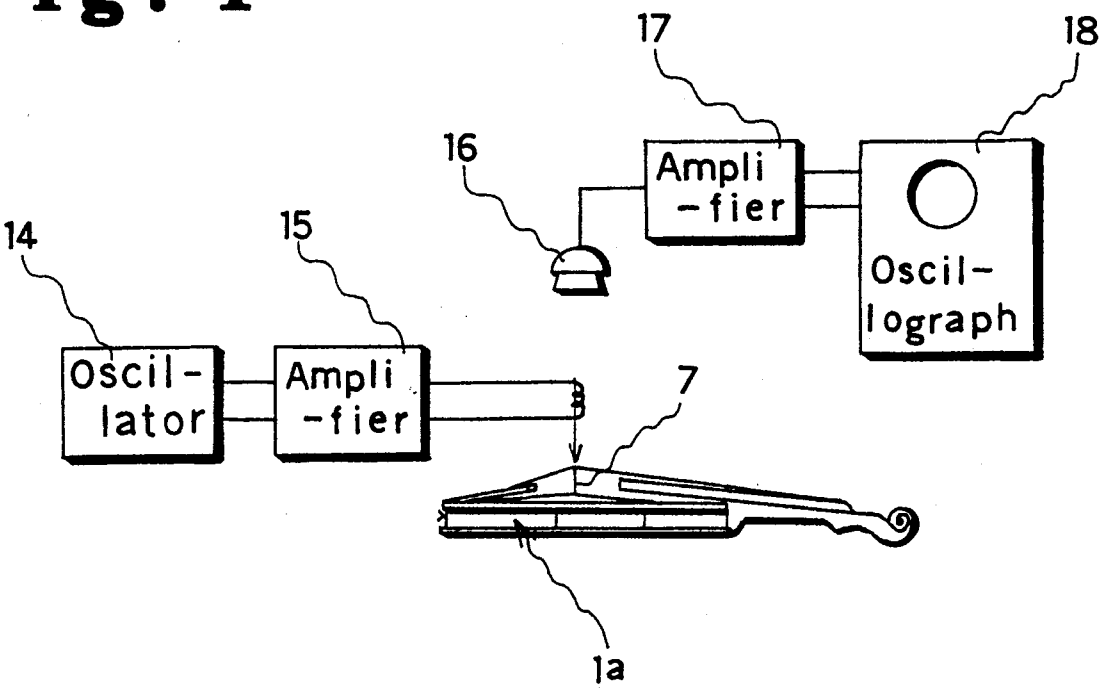
FIG. 4 is a diagram schematically showing a frequency characteristic measuring apparatus.
Figure 5:
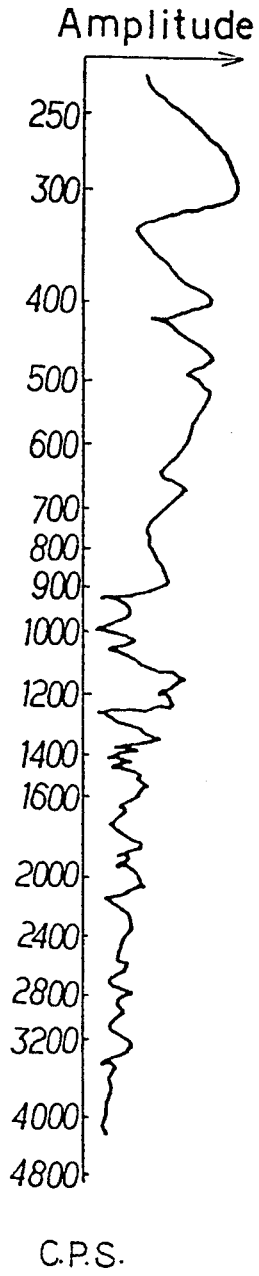
Fig. 5 (Prior art)
FIG. 5 is a graph showing the frequency characteristics of a body of a conventional violin.

Next, an investigation was made to sounds which most frequently appeared in music performances of the violin. Sounds available from a violin extend from G2 to G6 as shown in FIG. 3. It can be thought that if respective sounds are produced with different intensities, they of course provide different tone colors. If a violin cannot be designed to provide the best intensities and tone colors to all sounds produced thereby, the best possible conditions must be given to at least important sounds.

Figure 11:
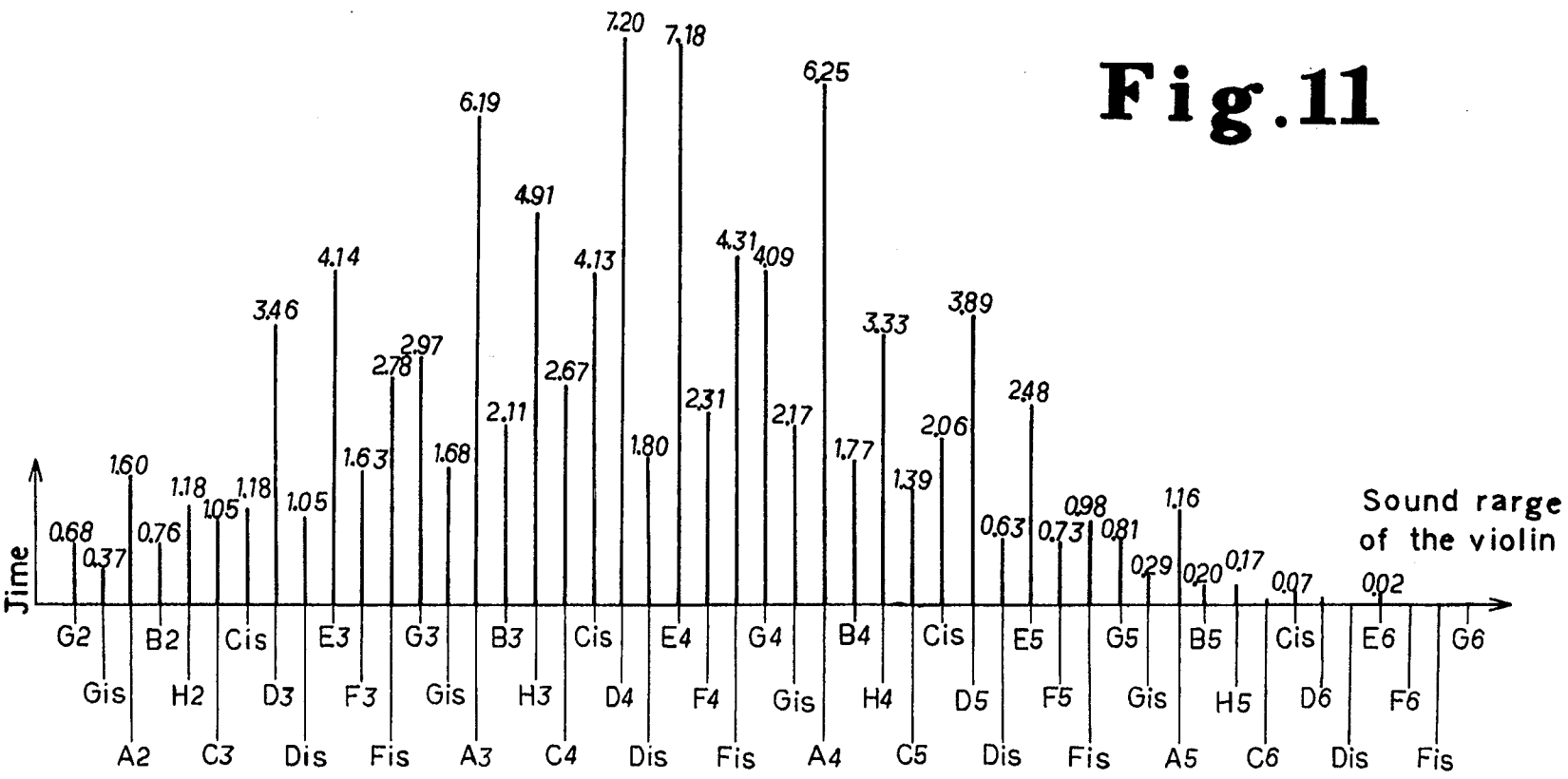
FIG. 11 is a graph showing the frequencies of sounds produced when playing a violin.

For this investigation, the inventors collected all violin programs broadcasted by Nippon Hoso Kyokai (NHK) for a year, picked Up all sounds from sheets of music, totalized the sounds in a manner that a quarter note corresponds to one; and an eighth note to one-half, and calculated playing time for each sound from metronome marking in accordance with the playing speed. FIG. 11 shows total times of respective sounds in the sound range of the violin, which seems to provide the playing frequencies of the respective sounds produced by the violin. As can be seen from FIG. 11, D4 and E4 present the highest values, and A3 and A4 the next highest values. It will be appreciated that at least these four sounds are significant for the violin. However, it has been known that E4 and A4 are particularly difficult for violins to produce. Special attention must therefore be paid to these significant sounds in terms of volume as well as quality.

Corresponding to the peak of the response curve of the body 2 is mainly reference vibrations of the top plate 9, so that the reference vibrations should be changed for improving the response curve. For this purpose, the vibration mode of the body plates are first measured for each reference vibration.

Figure 12:
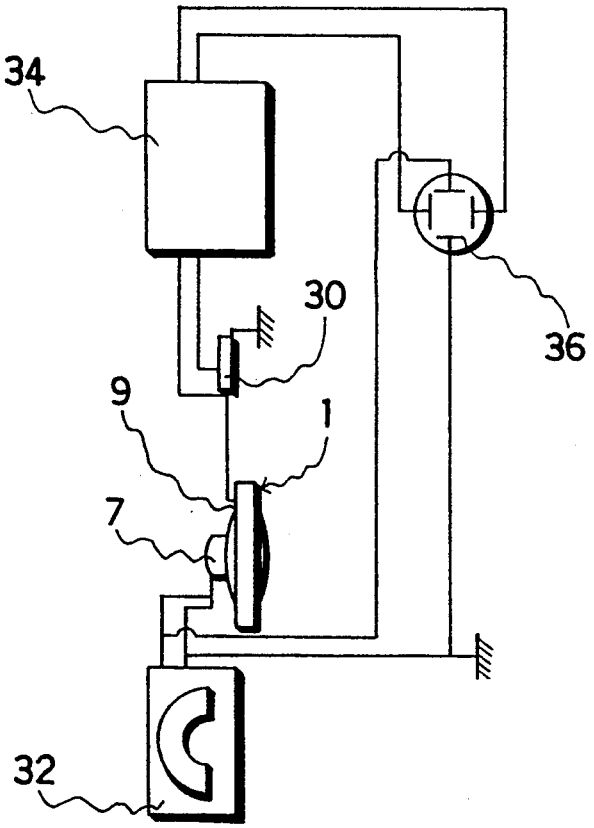
FIG. 12 is a diagram showing a body vibration mode measuring apparatus.
Figure 13:
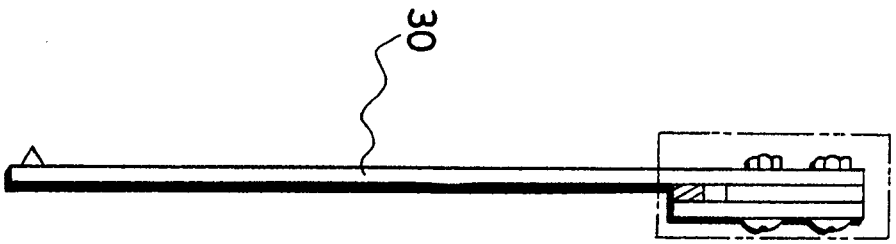
FIG. 13 is a lateral view showing a pickup.

A measuring method is shown in FIG. 12. When an excitation frequency of the body 2 becomes equal to one of the reference frequency of the top plate 9, a single vibration mode corresponding thereto only becomes remarkable, as described above, whereby the vibration of the top plate 9 presents clear nodal lines. Since the frequency of this reference vibration can be first derived from the peak of the response curve, the positions of the nodal lines at this time are detected by the following manner. An oscillator 32 is connected to the bridge 7 of the violin 1, a pickup 30 shown in FIG. 13 is brought into contact with the top plate 9, and is connected through an amplifier 34 to an oscilloscope 36. A pickup output and an oscillator output are Simultaneously supplied to the oscilloscope 36 to draw Lissajou's figure on the screen thereof. Generally, the drawn figure is an ellipse. Since the gradient direction of the ellipse changes depending upon positions of nodes, the nodal lines can be determined thereby.

FIG. 14 shows a basic vibration in the case where the direction of excitation is parallel to the top plate 9, where two nodal lines **19*a*, 19*b* are present in the direction perpendicular to this direction. Specifically, one of the nodal line 19*a* substantially passes through the position of the bass-bar 12, while the other one 19*b* passes through the position of the sound-post 13**.

The vibration mode in this basic vibration was completely common to other violins. It can therefore be thought that the vibration mode is determined only from an excitation method and structure, irrespective of the mass of body plates or the distribution of stiffness (if the stiffness of the top plate is supposed to include that of the bass bar 12 and the sound-post 13, the vibration mode is determined by the stiffness).

Now, consider the case where the violin 1 is played with the bow 8 as is the case of an actual performance. When playing the violin 1.with the bow 8, harmonics produced by vibration of the strings 6 causes many vibration modes to be simultaneously excited. However, when the frequency of the basic vibration of the strings 6 becomes equal to that of the top plate 9, the amplitude of the basic vibration of the top plate 9 is largely increased, so that the vibration mode thereof can be measured. The result of the measurement shows substantially the same as that of FIG. 14. It should be noted that this same vibration mode is obtained not only by the violin but also by a viola or cello. In addition, this extremely coincides with the case of sinusoidal wave excitation.

Incidentally, according to the experiment made by the inventors, it has been revealed that the nodal lines passed the substantially same positions in some harmonic vibrations at frequencies immediately above the foregoing case (see FIG. 15). In higher-order harmonics, the vibration modes of the top plate 9 become more complicated, and the positions of peaks are also close to each other.

In the foregoing vibration equation, $\rho h$ represents a mass of a unit area and is given by the following equation:

$$\frac{Eh^3}{12(1-\mu^3)}$$

Since the stiffness depends on $\rho h$, if a material of the top plate is determined, a mass is proportional to the thickness of the top plate, and the stiffness is proportional to a cube of the thickness.

It will be understood from the foregoing that the resonance frequency of the top plate is proportional to the thickness.

Thus, from a law found in terms of the vibration modes of the top plate, the frequency characteristic of a violin may be artificially modified. Specifically, supposing that a frequency band is divided into a higher region and a lower region, and a response curve of a high sound region is extended to the higher direction, the following process is considered:

$$\frac{Eh^3}{12(1-\mu^3)} = s \qquad \rho h = m$$

These equations are substituted for the foregoing equation expressing the resonance frequency to derive:

$$f = \frac{1}{2\pi}\sqrt{\frac{s}{m}} \cdot h^2$$

It will be appreciated from the above equation that if a method is taken to only increase the stiffness, the above object is achieved for the vibration mode in the high sound region. Utilizing the above described fact that the nodal lines pass through fixed positions in a low sound region, the method may be implemented by attaching two stiffeners along the nodal lines. This results in a different vibration mode in the high sound region, whereby the stiffness acts effectively, whereas the stiffness and mass of the attached stiffeners do not affect in the low sound region (see FIG. 6).

Figure 16:
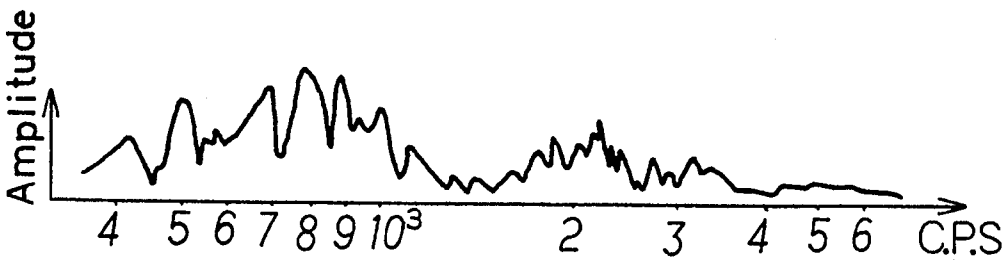
Fig. 16 is a graph showing the frequency characteristics of a violin according to the present invention together with a cross-sectional view of a body of the violin.
Figure 16:
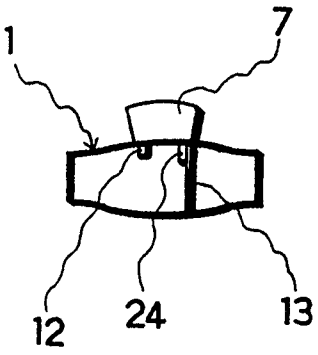
Figure 17:
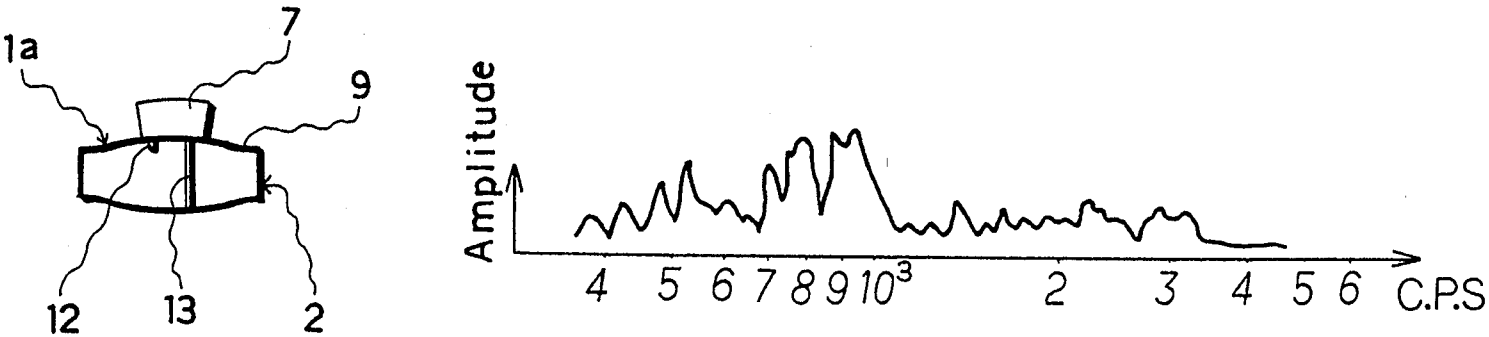
Fig. 17 (Prior art)
FIG. 17 is a graph showing the frequency characteristics of a conventional violin together with a cross-sectional view of a body of the violin.

The inventors made this testing for an experimental violin, where the response curve changed from FIG. 17 to FIG. 16.

Figure 18:
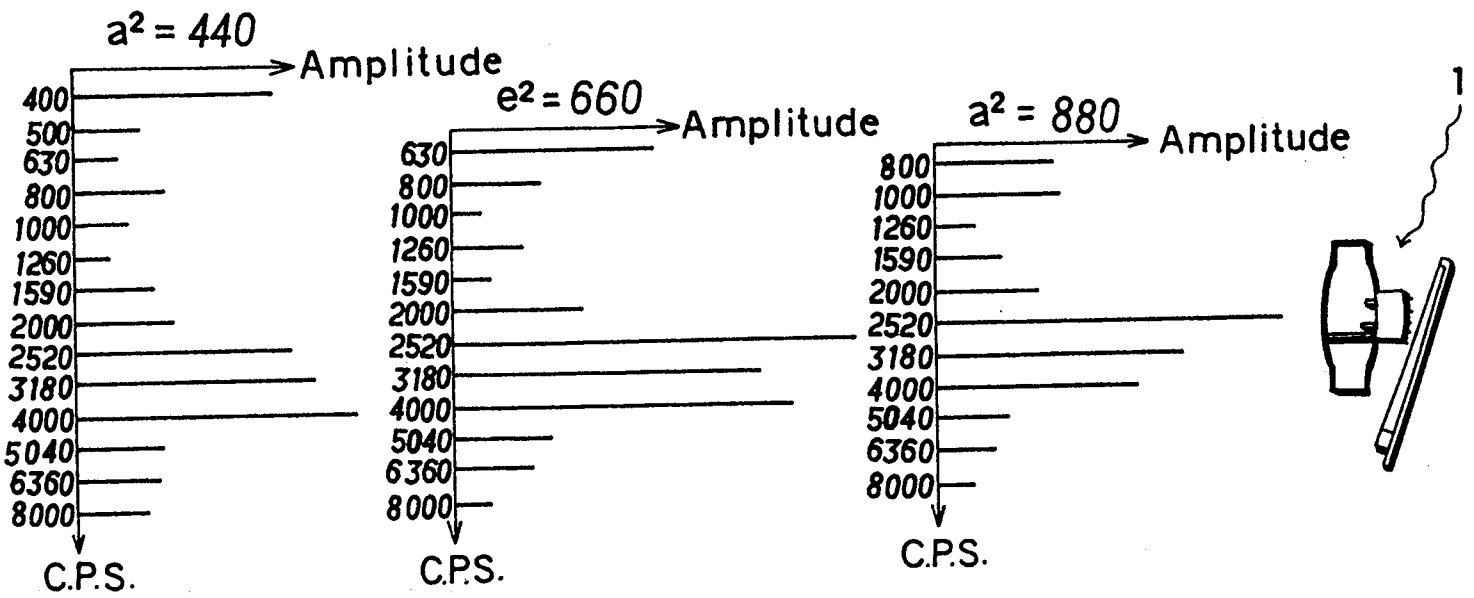
FIG. 18 comprises three graphs each showing the spectrum of sounds produced by the violin of the present invention.
Figure 19:
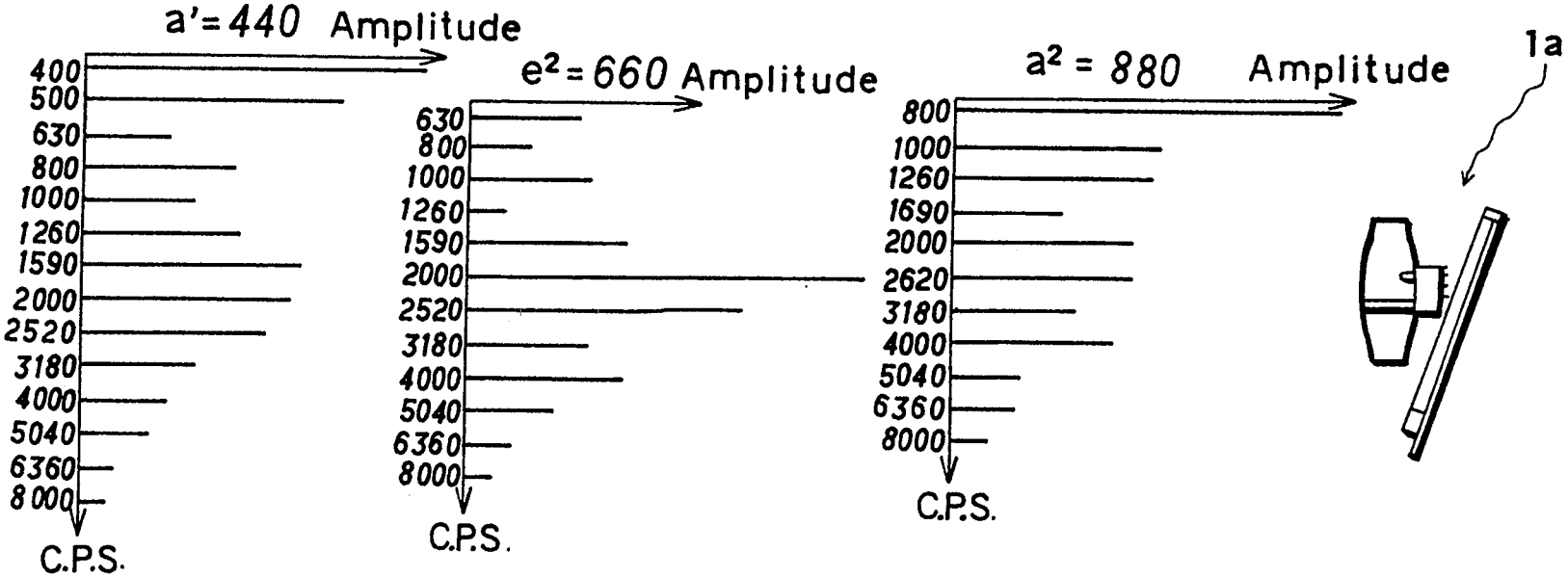
Fig. 19 (Prior art)
FIG. 19 comprises three graphs each showing the spectrum of sounds produced by a conventional violin.

Measurements of the resulting vibration modes show that several in the low sound region never changed, whereas those in the high sound region did change, whereby the frequency band extended in the higher direction. It is understood from the response curves of FIGS. 16 and 17 that the radiation of high sounds was increased. Also, a spectral analysis of sounds produced by playing the violin with a bow indicates that harmonics were increased as shown in FIGS. 19 and 18. While a sound range of the violin is up to about 3,000 C.P.S., the frequency range is largely extended in the higher direction if harmonics thereof are included.

As described above in detail, according to the string instrument of the present invention, the basic vibration of a top plate of a body is determined by the thickness and specific gravity of the top plate. If the basic vibration is equal to the basic vibration of a bow, the amplitude of the basic vibration of the top plate is largely increased, whereby the vibration modes thereof can be measured. Since the string instrument of the invention is provided with two stiffeners on two nodal lines appearing on the top plate as shown in FIGS. 14 and 15, that is, on lines where the amplitude becomes zero, stiffness obtained by the stiflenets acts to provide a different vibration mode in a high sound region, while the stiffness and mass of the two stiffeners do not affect in a relatively low sound region near the basic frequency of the top plate, whereby the frequency characteristic is shifted to the higher direction. From the response curve, it is understood that the radiation of high sounds was increased. Also a spectral analysis of sounds produced by playing the violin with a bow indicates that harmonics were increased.

Therefore, a frequency range of the violin remarkably extends in the higher direction. If a person hears sounds improved by the stiffeners with his ears, he will feel that the sounds in general have increased sweetness, and particularly the amount of sound on E-line is increased, which has been thought to be difficult for the violin to reliably produce. Further, the string instrument of the invention can produce E4 and A4 which are most frequently played but difficult to be produced by the violin, thereby largely increasing spread of sounds.

I claim:

1. In a string instrument played with a bow, said instrument having a body consisting of a top plate, a bottom plate, side plates and a sound post connecting said top and bottom plates, the improvement comprising a G-line side stiffener and an E-line side stiffener located on the rear surface of said top plate substantially in parallel to the stretching direction of the strings along two nodal lines respectively, the nodal lines being determined by measuring the vibration mode of said plate when the basic vibration of said strings is at the same frequency as that of said top plate, said E-line side stiffener being in contact with the sound post located between said top plate and said bottom plate.

2. The string instrument according to claim 1 wherein said sound post is positioned on the nodal line on the E-line side and immediately beneath the string bridge of the instrument.

3. In a string instrument played with a bow, said instrument having a top plate, a bottom plate, side plates and a sound post connecting said top and bottom plates, the improvement comprising a G-line side stiffener and an E-line side stiffener located on the rear surface of said top plate substantially in parallel to the stretching direction of the strings along two nodal lines respectively, the nodal lines being determined by measuring the vibration mode of said plate when the basic vibration of said strings is at the same frequency as that of said top plate, said E-line side stiffener being in contact with the sound post located between said top plate and said bottom plate wherein the E-line side stiffener is shorter than the G-line side stiffener.

* * * * *